US010304324B2

(12) United States Patent
Smith et al.

(10) Patent No.: US 10,304,324 B2
(45) Date of Patent: May 28, 2019

(54) CONTROL SYSTEM FOR A FAN

(71) Applicant: Dyson Technology Limited, Wiltshire (GB)

(72) Inventors: Arran George Smith, Bristol (GB); Orion Pardede, Glasgow (GB); David Dos Reis, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 495 days.

(21) Appl. No.: 14/136,284

(22) Filed: Dec. 20, 2013

(65) Prior Publication Data

US 2014/0178209 A1 Jun. 26, 2014

(30) Foreign Application Priority Data

Dec. 20, 2012 (GB) ..... 1223092.6

(51) Int. Cl.
*G08C 19/00* (2006.01)
*H01H 13/02* (2006.01)
(Continued)

(52) U.S. Cl.
CPC ..... *G08C 19/00* (2013.01); *F04F 5/16* (2013.01); *G08C 23/04* (2013.01); *H01H 13/023* (2013.01); *F04B 49/06* (2013.01)

(58) Field of Classification Search
CPC ..... G08C 23/04; G08C 23/06; G08C 19/00; F04F 5/16; H01H 13/023; H01H 13/026; H01H 2219/062; H01H 2219/0621; H01H 2219/036; H01H 2219/044; F04B 49/06; F04B 53/00
(Continued)

(56) References Cited

U.S. PATENT DOCUMENTS 5,099,193 A * 3/1992 Moseley ..... G08C 17/00 315/291
6,558,013 B2 * 5/2003 Tholin ..... H01H 13/023 116/279
(Continued)

FOREIGN PATENT DOCUMENTS

JP 5-190057 7/1993
JP 2000-133820 5/2000
(Continued)

OTHER PUBLICATIONS

Search Report dated Mar. 26, 2013, directed to GB Application No. 1223092.6; 2 pages.

*Primary Examiner* — Bryan M Lettman
*Assistant Examiner* — Charles W Nichols
(74) *Attorney, Agent, or Firm* — Morrison & Foerster LLP

(57) ABSTRACT

A control system is described for controlling an appliance, such as a fan. The control system includes a user-operable remote control for transmitting light signals, a control circuit for controlling at least one component of the appliance, such as a motor, and a user interface circuit for supplying control signals to the control circuit. The user interface circuit includes a switch and a receiver for receiving light signals transmitted by the remote control. A push button actuator both actuates the switch through movement of the actuator towards the switch, and conveys light signals received from the remote control to the receiver.

9 Claims, 7 Drawing Sheets

(51) Int. Cl.

| | |
|---|---|
| ***F04F 5/16*** | (2006.01) |
| ***G08C 23/04*** | (2006.01) |
| *F04B 49/06* | (2006.01) |

(58) Field of Classification Search
USPC ..... 200/310, 311, 313, 314, 317; 341/20
See application file for complete search history.

(56) References Cited

U.S. PATENT DOCUMENTS

| | | | | |
|---|---|---|---|---|
| 7,399,936 | B2 * | 7/2008 | Hurrle | H01H 19/025 200/310 |
| 7,670,039 | B2 * | 3/2010 | Altonen | G02B 6/0001 200/314 |
| 2007/0050982 | A1 | 3/2007 | Freund et al. | |
| 2007/0227864 | A1 * | 10/2007 | Tsai | G06F 1/181 200/293 |

FOREIGN PATENT DOCUMENTS

| | | |
|---|---|---|
| JP | 2000-324574 | 11/2000 |
| JP | 2001-266693 | 9/2001 |
| JP | 2003-170736 | 6/2003 |
| JP | 2008-155533 | 7/2008 |
| JP | 2009-506858 | 2/2009 |
| JP | 2011-99445 | 5/2011 |
| WO | WO-2009/030879 | 3/2009 |
| WO | WO-2011/055134 | 5/2011 |
| WO | WO-2012/017219 | 2/2012 |

* cited by examiner

CONTROL SYSTEM FOR A FAN

REFERENCE TO RELATED APPLICATIONS

This application claims the priority of United Kingdom Application No. 1223092.6, filed 20 Dec. 2012, the entire contents of which are incorporated herein by reference.

FIELD OF THE INVENTION

The present invention relates to a control system for controlling an appliance. Particularly, but not exclusively, the present invention relates to a control system for controlling a floor-standing or table-top fan, such as a desk, tower or pedestal fan, a fan heater, an air purifier or a humidifier. The present invention is not restricted to use in controlling a fan, and so may be used to control other appliances which use both a remote control and a push button or other moveable form of actuator to control an operational state or setting of the appliance.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades may be located within a cage or other housing which allows an air flow to pass through the housing while preventing users from coming into contact with the rotating blades during use of the fan.

WO 2009/030879 describes a fan assembly which does not use caged blades to project air from the fan assembly. Instead, the fan assembly comprises a cylindrical base which houses a motor-driven impeller for drawing a primary air flow into the base, and an annular nozzle connected to the base and comprising an annular air outlet through which the primary air flow is emitted from the fan. The nozzle defines a central opening through which air in the local environment of the fan assembly is drawn by the primary air flow emitted from the mouth, amplifying the primary air flow.

WO 2012/017219 also describes such a fan assembly. The base houses a user interface for enabling a user to control various operational states of the fan assembly. The user interface comprises a plurality of user-operable buttons, a display, and a user interface control circuit connected to the buttons and the display. The user interface control circuit has a sensor for receiving signals from a remote control. The sensor is located behind a window provided on the base. The display is located within the body, and is arranged to illuminate the inner surface of the body. The body is formed from a translucent plastics material which allows the display to be seen by a user. In response to operation of the buttons and the remote control, the user interface control circuit transmits appropriate signals to the main control circuit to control various operations of the fan assembly. These include the activation and de-activation of the motor, the rotational speed of the motor, and the activation and de-activation of an oscillating mechanism for oscillating a lower part of the base relative to an upper part of the base. A separate button is provided on each of the base and the remote control to allow the user to control each of these operations.

SUMMARY OF THE INVENTION

In a first aspect, the present invention provides a control system for controlling an appliance, the control system comprising:

- a remote control for transmitting light signals;
- a control circuit for controlling at least one component of the appliance;
- a user interface circuit for supplying control signals to the control circuit, the user interface circuit comprising a switch and a receiver for receiving light signals transmitted by the remote control; and
- an actuator, preferably a push button actuator, for actuating the switch through movement of the actuator towards the switch, and for conveying light signals received from the remote control to the receiver.

The actuator thus performs the dual function of actuating the switch, preferably in response to a user pushing the actuator towards the switch, and transferring to the receiver light signals which have been transmitted by the remote control and which are incident upon the actuator. This dual function of the actuator can allow the appliance to be provided without a dedicated window or other dedicated light transmissive component for conveying the signals transmitted by the remote control to the receiver, thereby reducing manufacturing costs. As there is no requirement to locate the receiver immediately behind a window provided on an external surface of the appliance, the receiver may be disposed in a more convenient location within the appliance, with the actuator shaped as required to convey signals to the receiver. For example, the receiver may be located adjacent to or alongside the switch to reduce the size of a printed circuit board upon which the components of the user interface circuit are mounted. Alternatively, the switch and the receiver may be located on opposite sides of the printed circuit board.

As mentioned above, the actuator is preferably a push button actuator which may be pressed by the user to contact the switch to change an operational mode, state or setting of the appliance. Alternatively, the actuator may be in the form of a slidable actuator, a rotatable actuator or dial. An advantage of providing the actuator in the form of a push button actuator is that a light path for conveying the light signals to the receiver can be maintained irrespective of the current position of the actuator relative to the switch.

The actuator may comprise a light guide or a light pipe formed in or otherwise carried by the actuator. In a preferred example, a part of the actuator is formed from light transmissive material to provide a path for conveying light signals received from the remote control to the receiver. This part of the actuator is preferably a moulded section of the actuator, and may be formed using an injection moulding technique. This can allow the section of the actuator to be readily formed to the desired shape for conveying the light signals to the receiver.

This part of the actuator preferably extends between a first surface which is exposed to light signals transmitted by the remote control, and a second surface which is located adjacent to the receiver. This first surface may be a surface which is engageable by a user to move the actuator towards the switch, and so conveniently this may be provided by a front surface of the actuator which is pushed by a user to actuate the switch. The second surface is preferably substantially parallel to the first surface, and may be provided by a rear surface of the actuator. The actuator is preferably moveable relative to the switch in a direction which is substantially perpendicular to the first surface.

The light signals transmitted by the remote control are preferably infrared light signals, and so this part of the actuator which conveys the light signals to the receiver is preferably formed from material which is transmissive of infrared light. One suitable example is polycarbonate material.

The actuator may comprise a single component formed from material which is transmissive of light having a wavelength which is the same as the wavelength of the light signals transmitted by the remote control. Alternatively, the actuator may be formed from a plurality of parts, sections or components which are joined or otherwise connected together, with at least one of these parts being formed from such light transmissive material. The other part(s) of the actuator may be formed from material which is opaque, or otherwise not so transmissive of light having a wavelength which is the same as the wavelength of the light signals transmitted by the remote control. This can create a discrete path for the passage of the light signals through the actuator to ensure that the light signals reach the receiver with an intensity which is sufficient for the light signals to be reliably detected at the receiver.

The user interface circuit is preferably arranged to transmit a signal to the control circuit which is indicative of the actuation of the switch. The user interface circuit may also advise the control circuit of de-actuation of the switch. The control circuit is preferably arranged to control an operational state or setting of the appliance in accordance with the signal received from the user interface circuit.

The user interface circuit may comprise a light emitting device for illuminating the actuator depending on the operational state or setting of the appliance. This is preferably the same operational state or setting which is controlled through actuation of the switch by the actuator. For example, the light emitting device may illuminate the actuator when the appliance is in an "on" state. Where the appliance is in the form of a fan, which term includes desk, tower and pedestal fans, fan heaters, air purifiers and humidifiers, the light emitting device may illuminate the actuator when a motor of a fan is in an "on" state to generate an air flow.

The light emitting device is preferably a light emitting diode (LED). The LED is preferably arranged to illuminate a third surface of the actuator which is spaced from the second surface of the actuator. The third surface is preferably parallel to the first surface, and may be provided by a rear surface of the actuator. The part of the actuator which conveys the light signals transmitted by the remote control to the receiver may also be arranged to convey the light emitted by the LED to a surface of the actuator which is visible to the user during use of the appliance. This may be the first surface of the actuator, or it may be a fourth surface of the actuator which is spaced from the first surface. The fourth surface may be contiguous with the first surface.

As an alternative to using this one part of the actuator to convey both the light signals received from the remote control to the receiver and the light signals received from the LED to an external surface of the actuator, the actuator may be provided with a first light conveying means for conveying light signals received from the remote control to the sensor, and a second light conveying means for conveying light emitted by the LED to an external surface of the actuator.

In a second aspect the present invention provides a control system for controlling an operational state of an appliance, the control system comprising:

a remote control for transmitting light signals;

a control circuit for controlling at least one component of the appliance;

a user interface circuit for supplying control signals to the control circuit, the user interface circuit comprising a switch, a receiver for receiving light signals transmitted by the remote control, and a light emitting device for indicating the operational state of the appliance; and an actuator for actuating the switch through movement of the actuator towards the switch, the actuator comprising light conveying means for conveying light signals received from the remote control to the sensor, and for conveying light emitted by the light emitting device to an external surface of the actuator.

The second light conveying means may have a lower infrared transmittance than the first light conveying means. The first light conveying means may have a lower visible light transmittance than the second light conveying means.

These two light conveying means may be provided by separate components of the actuator. Each light conveying means may be provided by a respective light guide or light pipe. Alternatively, only one of the light conveying means may be provided by a light guide or light pipe, with the other light conveying means being provided by a moulded part of the actuator. As another alternative, each light conveying means may be provided by a respective moulded part of the actuator. These moulded parts may be formed from different light transmissive materials. As a further alternative, these moulded parts may be formed from the same light transmissive materials, and so these parts may be integral with each other, or they may be otherwise joined together. The parts may have any desired configuration. For example, the parts may be arranged side by side, or one part may at least partially surround the other part.

In a preferred embodiment, the actuator comprises a single component which is arranged to convey infrared light signals from a first, external surface of the actuator to a second, internal surface located adjacent to the receiver, and to convey visible light signals to the external surface of the actuator from a third, internal surface located adjacent to the light emitting device.

The actuator is preferably biased away from the switch. For example, a spring or other resilient member may engage the actuator to urge the actuator away from the switch. The resilient member may be located between the actuator and the printed circuit board, or it may be located between the actuator and a structural part of the appliance. The structural part of the appliance may be connected to an outer wall of the appliance, or it may be connected to a frame or other member for supporting the printed circuit board within the appliance. As an alternative to providing a separate resilient member for urging the actuator away from the switch, the actuator may comprise one or more resilient arms which normally engage a wall or other structural part of the appliance. When the actuator is moved towards the switch, the arms deform elastically to generate internal forces which, when the actuator is released by the user, urge the actuator away from the switch as the arms relax.

The user interface circuit may include a display for displaying information relating to an operational state of the appliance. The display is preferably mounted on the printed circuit board, and the actuator is preferably located beneath the display.

The control circuit is preferably arranged to change an operational state or setting of the appliance in response to the actuation of the switch by the user. The appliance may be any electrical appliance which has an operational state or setting which may be controlled using both an actuator provided on the appliance and a remote control. In a described embodiment, the appliance is in the form of a fan, comprising an air inlet, an air outlet and a motor for rotating an impeller to generate an air flow from the air inlet to the air outlet. The operational state or setting of the fan may comprise one of the current rotational speed of the motor, the current activation state (on or off) of the motor, and the current activation state (on or off) of an oscillation mechanism for oscillating one part of the fan relative to another part of the fan. If the fan includes a heater, then the operational state or setting of the fan may comprise the current activation state (on or off) of the heater or a current temperature setting of the fan.

The user interface circuit is preferably arranged to communicate the actuation of the switch to the control circuit. The control circuit is preferably in the form of a separate printed circuit board assembly. The control circuit preferably comprises a microcontroller or microprocessor unit, a power supply unit for receiving power from a power source, such as a mains power source, and a motor driver, preferably a brushless DC motor driver, for controlling the rotational speed of the motor. Where the fan includes an oscillation mechanism for oscillating part of the fan, for example the air outlet, relative to another part of the fan, for example the air inlet, the control circuit may also include oscillation motor control circuitry for driving the oscillation mechanism.

The action taken by the control circuit in response to the actuation of the switch may depend on a current operational state or setting of the fan, and the action which is assigned to the actuation of the switch. For example, if the motor is currently activated so that the fan is in an "on" state, the control circuit may de-activate the motor in response to the actuation of the switch to place the fan in an "off" state. On the other hand, if the motor is currently de-activated so that the fan is in the "off" state, the control circuit may activate the motor in response to the actuation of the switch to place the fan in the "on" state. Thus, pressing the actuator may simply toggle the fan between the "on" and "off" states. The control circuit may instruct the user interface circuit to activate the LED when the fan is in the "on" state.

Alternatively, if the oscillation mechanism is currently activated, the control circuit may de-activate the oscillation mechanism in response to the actuation of the switch. On the other hand, if the oscillation mechanism is currently de-activated, the control circuit may activate the oscillation mechanism in response to the actuation of the switch. Thus, pressing the actuator may simply toggle the oscillation mechanism between active and inactive states.

Such a change in an operational state of the fan also may be effected by the user through use of the remote control. For example, when the user presses a specific "on/off" button of the remote control, the remote control transmits a unique infrared control signal which is received by the receiver of the user interface circuit. The user interface circuit communicates the receipt of this signal to the control circuit, in response to which the control circuit activates or de-activates the motor as appropriate. As another example, when the user presses a specific "oscillate" button of the remote control, the remote control transmits a different, unique infrared control signal which is received by the receiver of the user interface circuit. The user interface circuit communicates the receipt of this signal to the control circuit, in response to which the control circuit activates or de-activates the oscillation mechanism as appropriate.

The fan may be configured so as to allow the user to select one of a number of different pre-defined speed settings for the rotational speed of the motor, and thus for the flow rate of the air emitted from the air outlet. The fan preferably comprises at least five different user selectable speed settings, and more preferably at least eight different user selectable speed settings. In a preferred example, the fan has ten different speed settings, and the user is able to select from setting "1" to setting "10". Speed setting 1 may correspond to a relatively low rotational speed of the motor, whereas speed setting 10 may correspond to a relatively high rotational speed of the motor. The motor is preferably in the form of a DC motor to maximise the number of different speed settings which may be selected by the user. The number of the selected speed setting may be displayed on the display. The user may never be aware of the actual rotational speed of the motor, but aware only that selection of a higher rated speed setting increases the flow rate of air emitted from the fan.

A change in the rotational speed of the motor also may be effected by the user through use of the remote control. For example, when the user presses a specific "speed up" button of the remote control, the remote control transmits a unique infrared control signal which is received by the receiver of the user interface circuit. The user interface circuit communicates the receipt of this signal to the control circuit, in response to which the control circuit increases the rotational speed of the motor to the speed associated with the next highest speed setting, and instructs the user interface circuit to display that speed setting on the display. If the user presses a specific "speed down" button of the remote control, the remote control transmits a different, unique infrared control signal which is received by the receiver of the user interface circuit. The user interface circuit communicates the receipt of this signal to the control circuit, in response to which the control circuit decreases the rotational speed of the motor to the speed associated with the next lowest speed setting, and instructs the user interface circuit to display that speed setting on the display.

The user interface circuit may comprise one or more buttons or dials, or a touch sensitive screen, to allow the user to select the desired speed setting. In a preferred embodiment, the actuator is used both to change the operational (on/off) state of the motor and to change the rotational speed of the motor. The operation which is performed by the control circuit in response to the actuation of the switch may depend on the duration of the contact made between the actuator and the switch. For example, the control circuit may be configured to change the operational state of the motor, i.e. turn the motor on or off, when the duration of the contact made between the actuator and the switch is relatively short, or below a set value, and to change the rotational speed of the motor when the duration of the contact made between the actuator and the switch is relatively long, or above the set value. The set value may be in the range from 0.5 to 5 seconds, for example 1 second.

When the duration of the contact between the switch and the actuator is above the set value, the control circuit may increase the rotational speed of the fan from the rotational speed associated with the current setting to the rotational speed associated with the next highest speed setting. If the user continues to depress the actuator against the switch, the control circuit may vary the rotational speed of the motor between a maximum rotational speed associated with the highest user selectable speed setting, and a minimum rotational speed associated with the lowest user selectable speed setting, until the user releases the actuator.

In a third aspect the present invention provides a fan comprising:

an air inlet;

an air outlet;

an impeller and a motor for rotating the impeller to draw air through the air inlet;

a control circuit for controlling the motor;

a remote control for transmitting light signals;

a user interface circuit for supplying control signals to the control circuit, the user interface circuit comprising a switch and a receiver for receiving light signals transmitted by the remote control; and an actuator for actuating the switch through movement of the actuator towards the switch and for conveying light signals received from the remote control to the receiver.

Features described above in connection with the first aspect of the invention are equally applicable to each of the second and third aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
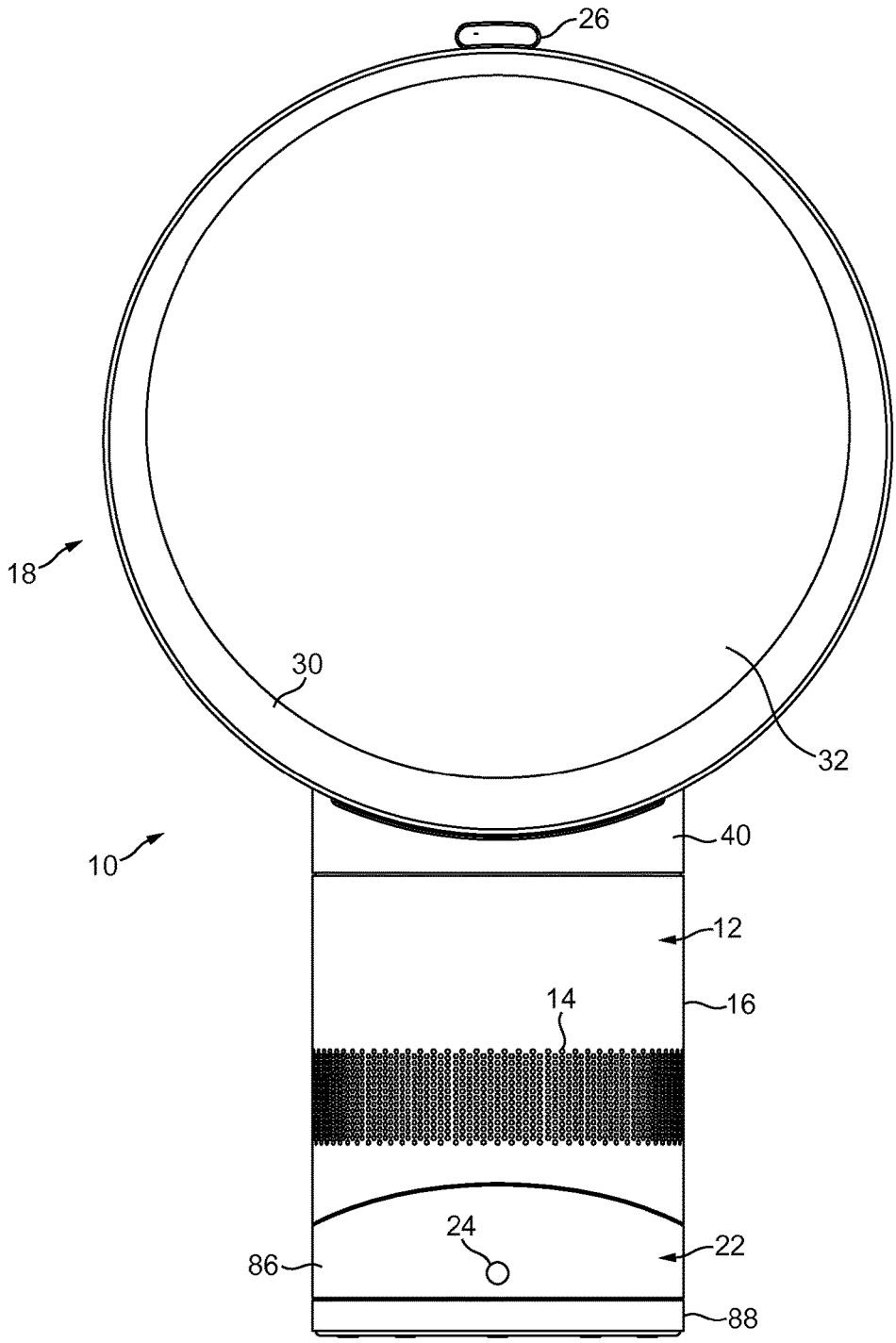
FIG. 1 is a front view of a fan.

FIG. 1 is a front view of a fan assembly 10. The fan assembly 10 comprises a body 12 having an air inlet 14 in the form of a plurality of apertures formed in the outer casing 16 of the body 12, and through which a primary air flow is drawn into the body 12 from the external environment. An annular nozzle 18 having an air outlet 20 (shown in FIG. 2) for emitting the primary air flow from the fan assembly 10 is connected to the upper end of the body 12. The body 12 is mounted on a base 22 so as to allow the body 12 to tilt relative to the base 22. The base 22 comprises a user-operable actuator 24 for allowing a user to control an operational state of the fan assembly 10. The fan assembly 10 also includes a remote control 26 for allowing the user to control, remotely from the fan assembly 10, operational states and settings of the fan assembly 10. When not in use, the remote control 26 may be stored on the upper surface of the nozzle 18, as illustrated in FIG. 1.

Figure 2:
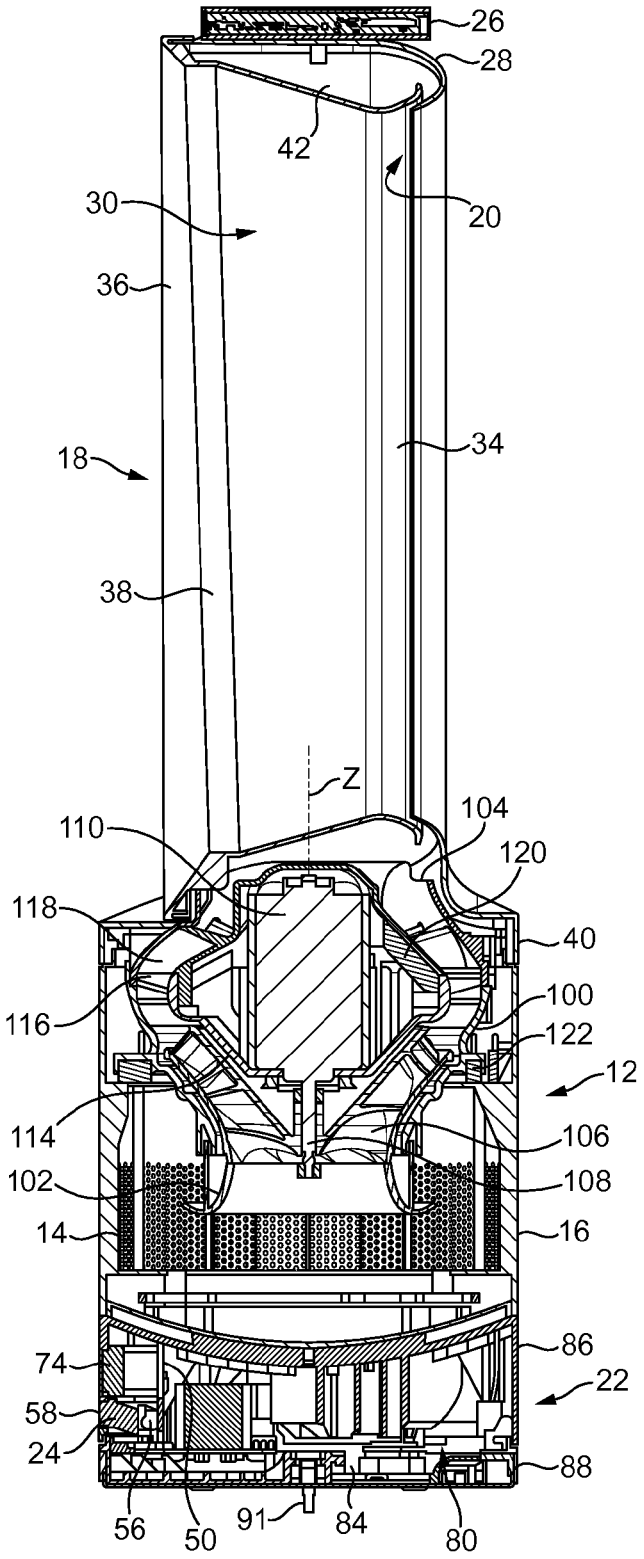
FIG. 2 is a side sectional view of the fan.
Figure 3:
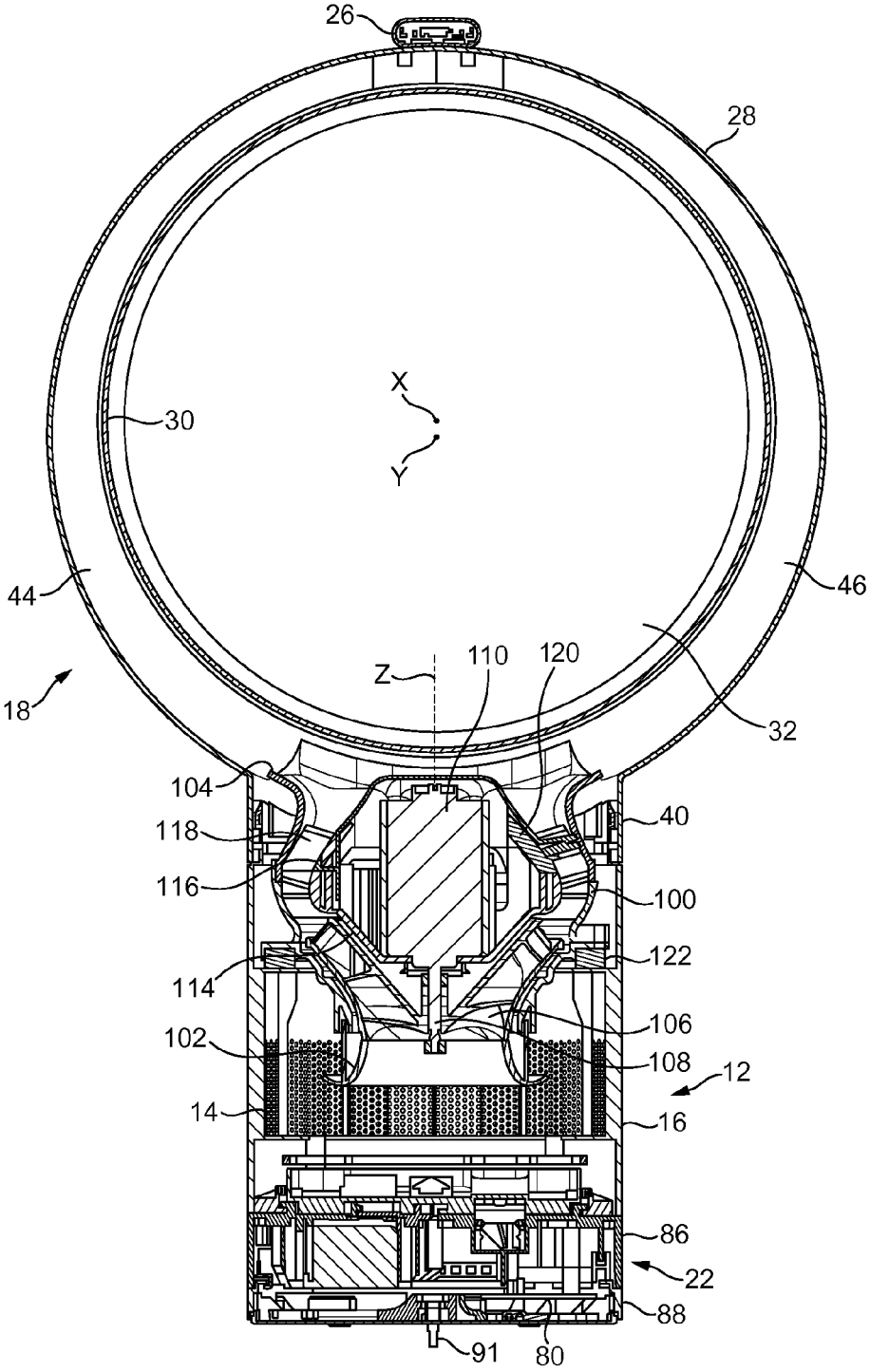
FIG. 3 is a front sectional view of the fan.

The nozzle 18 has an annular shape. With reference also to FIGS. 2 and 3, the nozzle 18 comprises an outer wall 28 extending about an annular inner wall 30. In this example, each of the walls 28, 30 is formed from a separate component. Each of the walls 28, 30 has a front end and a rear end. The rear end of the outer wall 28 curves inwardly towards the rear end of the inner wall 30 to define a rear end of the nozzle 18. The front end of the inner wall 30 is folded outwardly towards the front end of the outer wall 28 to define a front end of the nozzle 18. The front end of the outer wall 28 is inserted into a slot located at the front end of the inner wall 30, and is connected to the inner wall 30 using an adhesive introduced to the slot.

The inner wall 30 extends about an axis, or longitudinal axis, X to define a bore, or opening, 32 of the nozzle 18. The bore 32 has a generally circular cross-section which varies in diameter along the axis X from the rear end of the nozzle 18 to the front end of the nozzle 18.

The inner wall 30 is shaped so that the external surface of the inner wall 30, that is, the surface that defines the bore 32, has a number of sections. The external surface of the inner wall 30 has a convex rear section 34, an outwardly flared frusto-conical front section 36 and a cylindrical section 38 located between the rear section 34 and the front section 36.

The outer wall 28 comprises a base 40 which is connected to an open upper end of the body 12, and which has an open lower end which provides an air inlet for receiving the primary air flow from the body 12. The majority of the outer wall 28 is generally cylindrical in shape. The outer wall 28 extends about a central axis, or longitudinal axis, Y which is parallel to, but spaced from, the axis X. In other words, the outer wall 28 and the inner wall 30 are eccentric. In this example, the axis X is located above the axis Y, with each of the axes X, Y being located in a plane which extends vertically through the centre of the fan assembly 10.

The rear end of the outer wall 28 is shaped to overlap the rear end of the inner wall 30 to define the air outlet 20 of the nozzle 18 between the inner surface of the outer wall 28 and the outer surface of the inner wall 30. The air outlet 20 is in the form of a generally circular slot centred on, and extending about, the axis X. The width of the slot is preferably substantially constant about the axis X, and is in the range from 0.5 to 5 mm. The overlapping portions of the outer wall 28 and the inner wall 30 are substantially parallel, and are arranged to direct air over the convex rear section 34 of the inner wall 30, which provides a Coanda surface of the nozzle 18.

The outer wall 28 and the inner wall 30 define an interior passage 42 for conveying air to the air outlet 20. The interior passage 42 extends about the bore 32 of the nozzle 18. In view of the eccentricity of the walls 28, 30 of the nozzle 18, the cross-sectional area of the interior passage 42 varies about the bore 32. The interior passage 42 may be considered to comprise first and second curved sections 44, 46 which each extend in opposite angular directions about the bore 32. Each curved section 44, 46 of the interior passage 42 has a cross-sectional area which decreases in size about the bore 32.

The body 12 and the base 22 are preferably formed from plastics material. The body 12 and the base 22 preferably have substantially the same external diameter so that the external surface of the body 12 is substantially flush with the external surface of the base 22 when the body 12 is in an untilted position relative to the base 22.

The body 12 comprises the air inlet 14 through which the primary air flow enters the fan assembly 10. In this example the air inlet 14 comprises an array of apertures formed in the section of the outer casing 16 of the body 12. Alternatively, the air inlet 14 may comprise one or more grilles or meshes mounted within windows formed in the outer casing 16. The body 12 is open at the upper end (as illustrated) for connection to the base 40 of the nozzle 18, and to allow the primary air flow to be conveyed from the body 12 to the nozzle 18.

Figure 4:
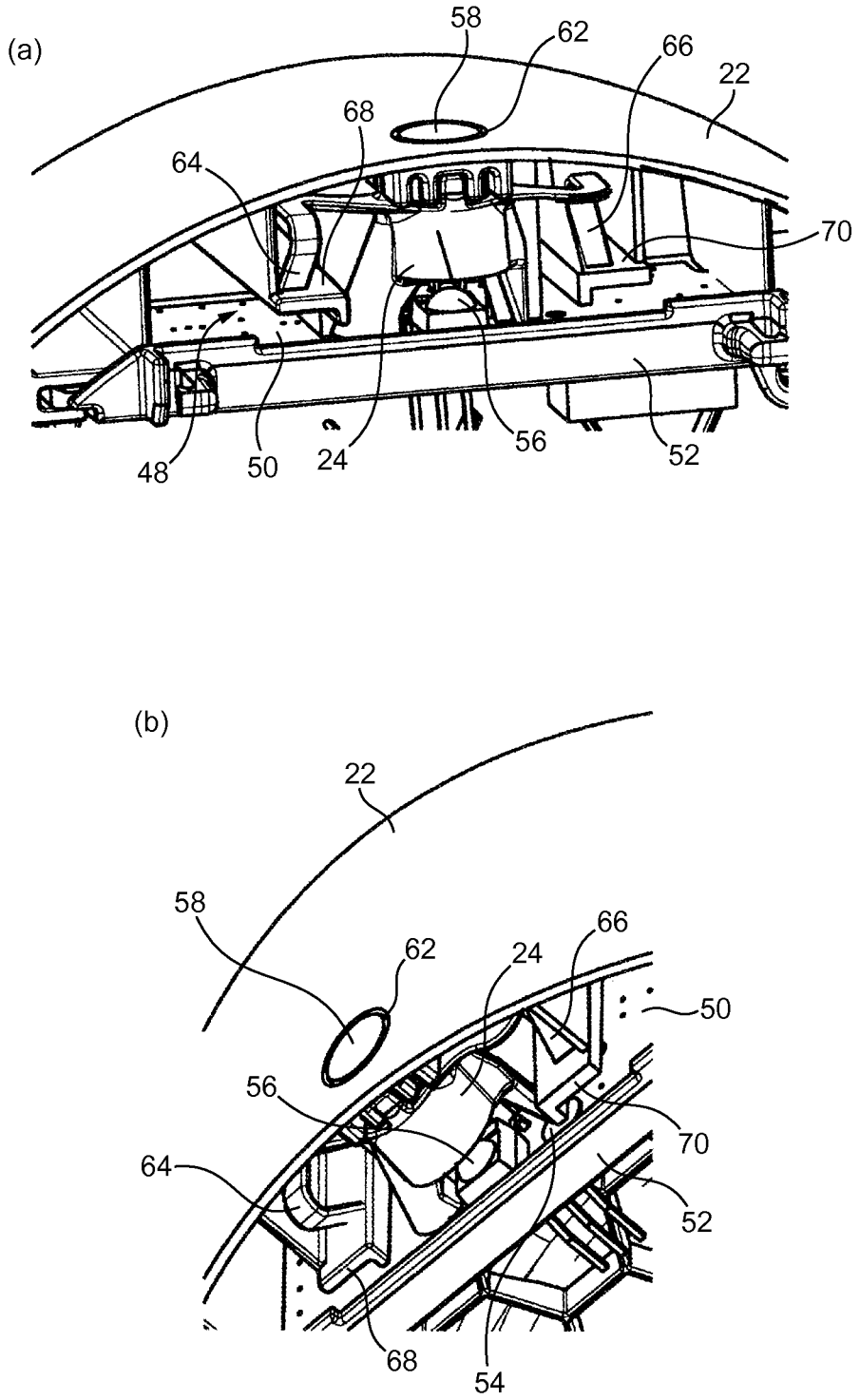
FIG. 4(*a*) is a first perspective view, from below, of part of the upper base member of the fan, and FIG. 4(*b*) is a second perspective view, from below, of part of the upper base member of the fan, FIG. 5(*a*) is a first perspective view, from below, of a user interface circuit of the fan, FIG. 5(*b*) is a second perspective view, from above, of the user interface circuit, and FIG. 5(*c*) is a third perspective view, from below, of the user interface circuit.
Figure 5:
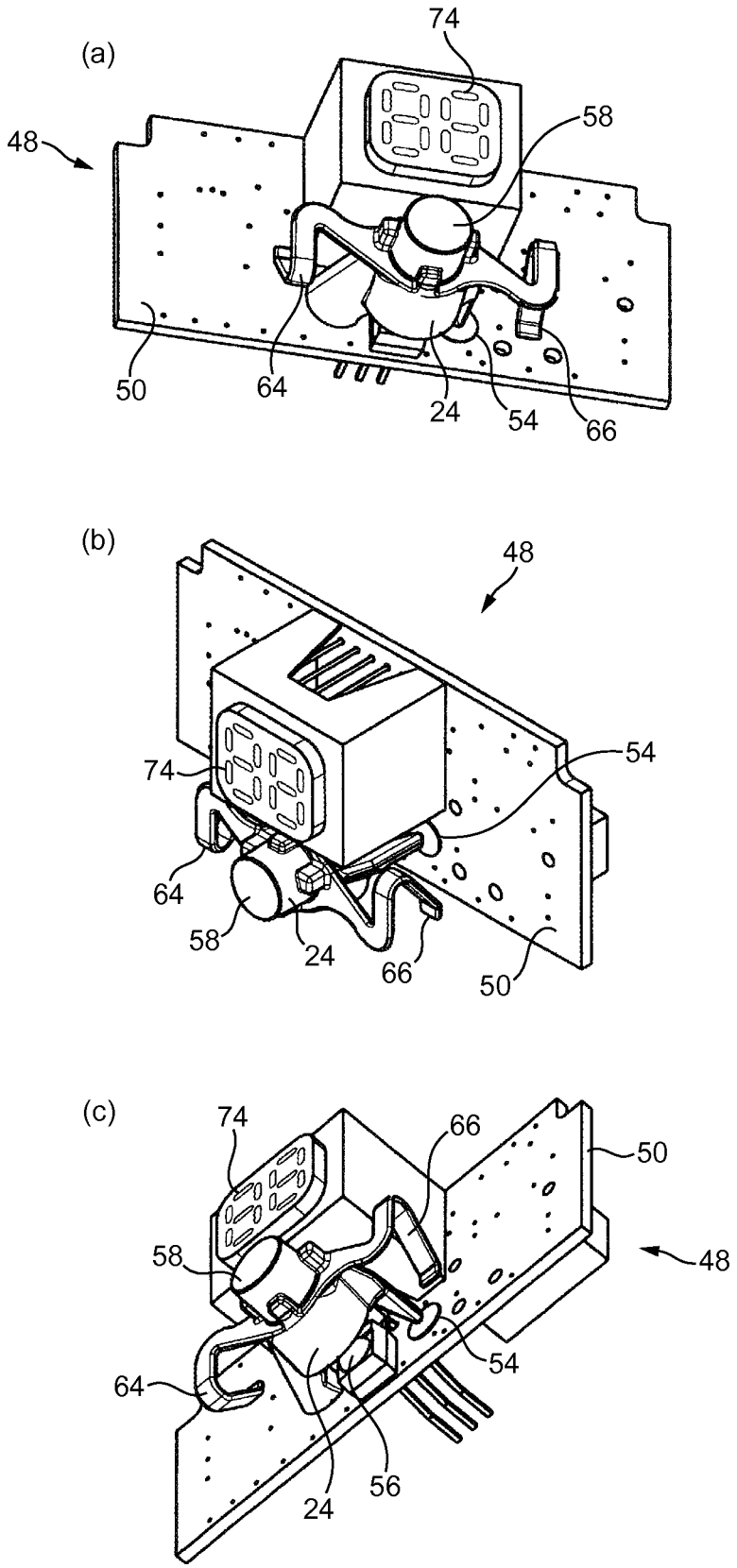
Figure 6:
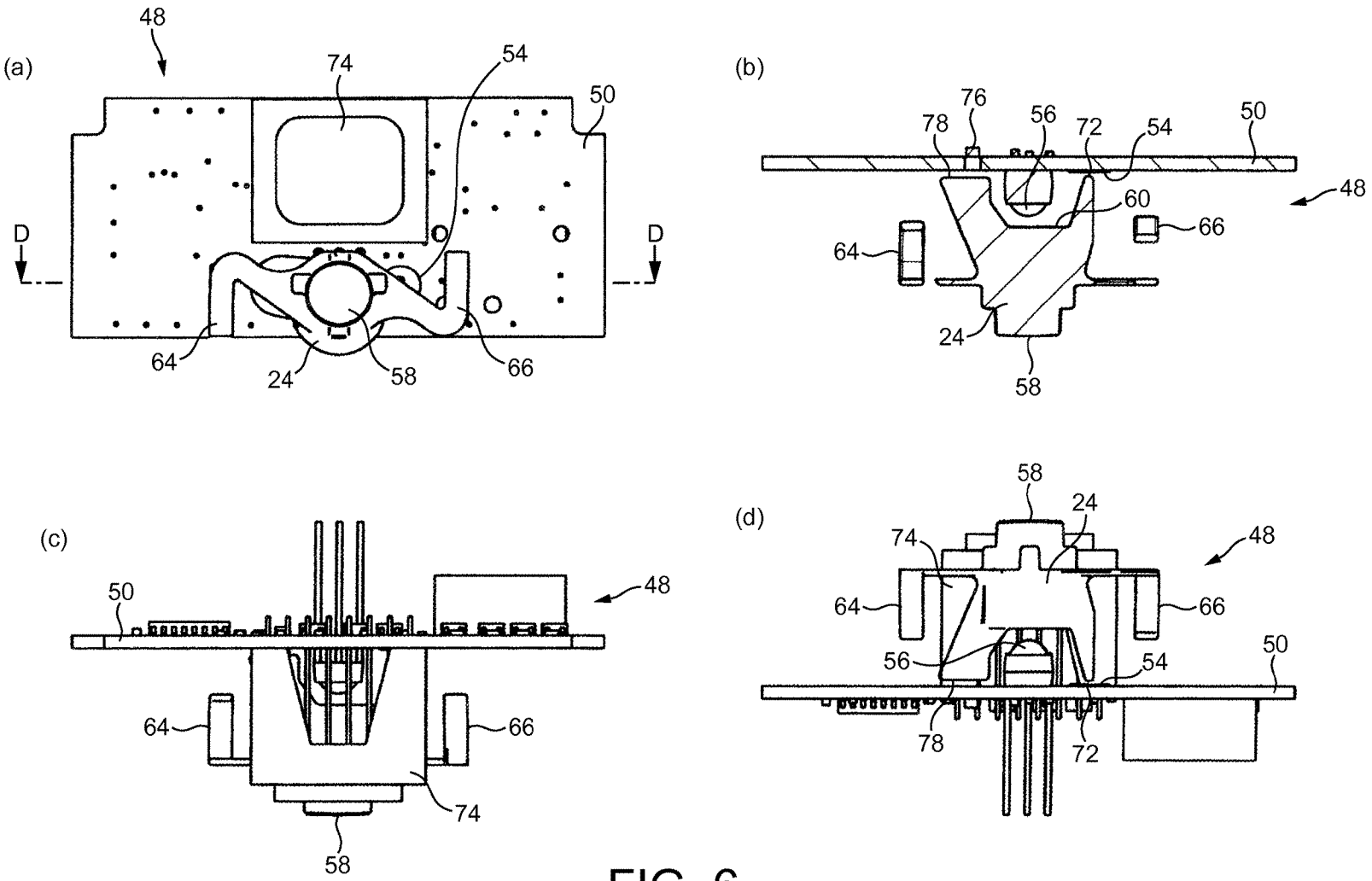
FIG. 6(*a*) is a front view of the user interface circuit, FIG. 6(*b*) is a sectional view taken along line D-D in FIG. 6(*a*), FIG. 6(*c*) is a top view of the user interface circuit, and FIG. 6(*d*) is a bottom view of the user interface circuit.
Figure 7:
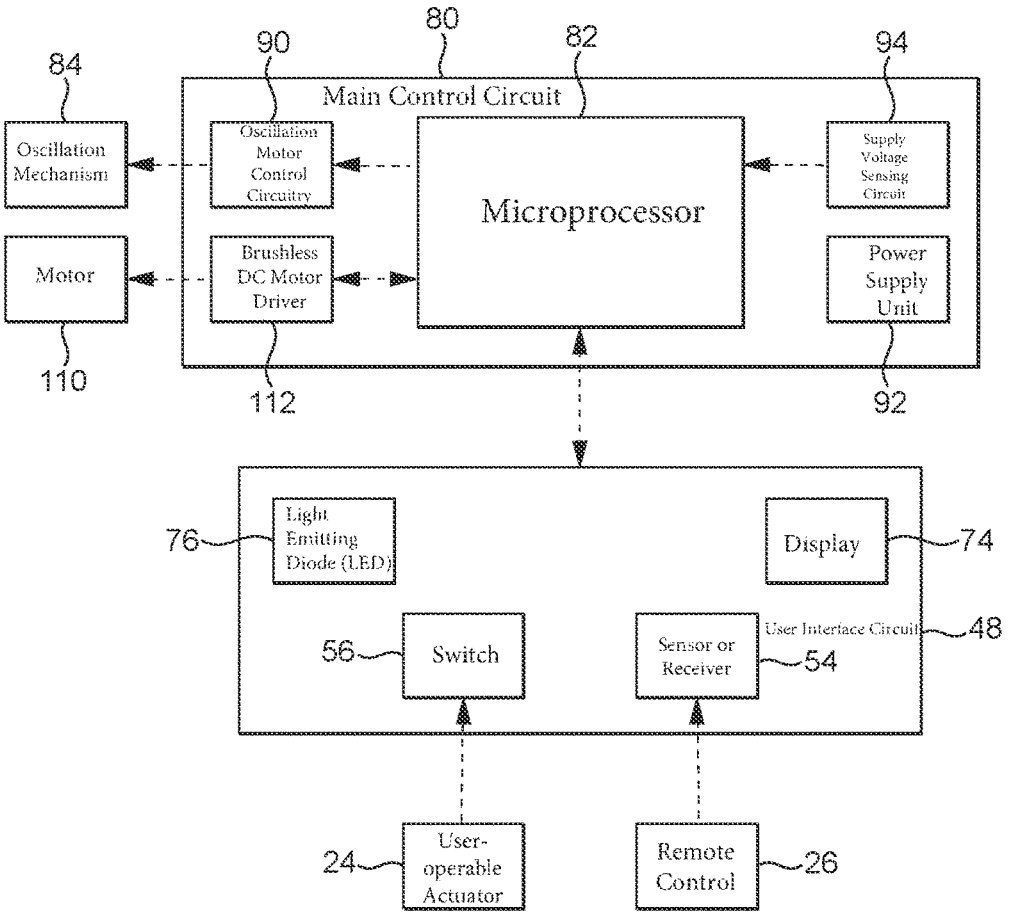
FIG. 7 is a schematic illustration of components of the user interface circuit and a control circuit of the fan.

With reference also to FIGS. 4 to 6, the base 22 houses a user interface circuit 48. The user interface circuit 48 comprises a number of components which are mounted on a printed circuit board 50. The printed circuit board 50 is held in a frame 52 connected to the outer surface of the base 22. The user interface circuit 48 comprises a sensor or receiver 54 for receiving signals transmitted by the remote control 26. In this example, the signals emitted by the remote control 26 are infrared light signals. The remote control 26 is similar to the remote control described in WO 2011/055134, the contents of which are incorporated herein by reference. In overview, the remote control 26 comprises a plurality of buttons which are depressible by the user, and a control unit for generating and transmitting infrared light signals in response to depression of one of the buttons. The infrared light signals are emitted from a window located at one end of the remote control 26. The control unit is powered by a battery located within a battery housing of the remote control 26.

The user interface control circuit 48 also comprises a switch 56 which is actuable by a user through operation of the actuator 24. In this example, the actuator 24 is in the form of a push button actuator which has a front surface 58 can be pressed by a user to cause a rear surface 60 of the actuator 24 to contact the switch 56. The front surface 58 of the actuator 24 is accessible through an aperture 62 formed in the outer surface of the base 22. The actuator 24 is biased away from the switch 56 so that, when a user releases the actuator 24, the rear surface 60 of the actuator 24 moves away from the switch 56 to break the contact between the actuator 24 and the switch 56. In this example, the actuator 24 comprises a pair of resilient arms 64, 66. The end of each arm 64, 66 is located adjacent to a respective internal wall 68, 70 of the base 22. When a user presses the actuator 24, the engagement between the ends of the arms 64, 66 and the walls 68, 70 causes the arms 64, 66 to deform elastically as the actuator 24 moves towards the switch 56. When the user releases the actuator 24, the arms 64, 66 relax so that the actuator 24 moves automatically away from the switch 56.

The actuator 24 also performs the function of transferring to the receiver 54 light signals which have been transmitted by the remote control 26 and which are incident upon the front surface 58 of the actuator 24. In this example, the actuator 24 is a single moulded component which is formed from light transmissive material, for example a polycarbonate material. A second rear surface 72 of the actuator 24 is located adjacent to the receiver 54, and so part of the actuator 24 which extends between the front surface 58 and this second rear surface 72 provides a path for the transmitted infrared light signals.

The user interface circuit 48 further comprises a display 74 for displaying a current operational setting of the fan assembly 10, and a light emitting diode (LED) 76 which is activated depending on a current operational state of the fan assembly 10. The display 74 is preferably located immediately behind a relatively thin portion of the outer casing of the base 22 so that the display 74 is visible to the user through the outer casing of the base 22. In this example, the LED 76 is activated when the fan assembly 10 is in an "on" state, in which an air flow is generated by the fan assembly 10. In this example, the actuator 24 is also arranged to transfer light emitted by the LED 76 to the front surface 58 of the actuator 24. The actuator 24 has a third rear surface 78 which is located adjacent to the LED 76, and so part of the actuator 24 which extends between the front surface 58 and this third rear surface 72 provides a path for the light signals emitted by the LED 76. The third rear surface 78 is spaced from the second rear surface 72.

The base 22 also houses a main control circuit, indicated generally at 80, connected to the user interface circuit 48. The main control circuit 80 comprises a microprocessor 82, which is illustrated schematically in FIG. 12. The base 22 also houses a mechanism, indicated generally at 84, for oscillating an upper section 86 of the base 22 relative to a lower section 88 of the base 22. The main control circuit 80 comprises oscillation motor control circuitry 90 for driving the oscillation mechanism 84. The operation of the oscillating mechanism 84 is controlled by the main control circuit 80 upon receipt of an appropriate control signal from the remote control 26. The range of each oscillation cycle of the upper section 86 relative to the lower section 88 is preferably between 60° and 120°, and in this example is around 80°. In this example, the oscillating mechanism 84 is arranged to perform around 3 to 5 oscillation cycles per minute. A mains power cable 91 for supplying electrical power to the fan assembly 10 extends through an aperture formed in the lower section 88. The cable 91 is connected to a plug (not shown). The main control circuit 80 comprises a power supply unit 92 connected to the cable 91, and a supply voltage sensing circuit 94 for detecting the magnitude of the supply voltage.

Returning to FIGS. 2 and 3, the body 12 comprises a duct 100 having a first end defining an air inlet 102 of the duct 100 and a second end located opposite to the first end and defining an air outlet 104 of the duct 100. The duct 100 is aligned within the body 12 so that the longitudinal axis of the duct 100 is collinear with the longitudinal axis of the body 12, and so that the air inlet 102 is located beneath the air outlet 104.

The duct 100 extends about an impeller 106 for drawing the primary air flow into the body 12 of the fan assembly 10. The impeller 106 is a mixed flow impeller. The impeller 106 comprises a generally conical hub, a plurality of impeller blades connected to the hub, and a generally frusto-conical shroud connected to the blades so as to surround the hub and the blades. The blades are preferably integral with the hub, which is preferably formed from plastics material.

The impeller 106 is connected to a rotary shaft 108 extending outwardly from a motor 110 for driving the impeller 106 to rotate about a rotational axis Z. The rotational axis Z is collinear with the longitudinal axis of the duct 100 and orthogonal to the axes X, Y. In this example, the motor 110 is a DC brushless motor having a speed which is variable by a brushless DC motor driver 112 of the main control circuit 80. As described in more detail below, the user may adjust the speed of the motor using the actuator 24 or the remote control 26. In this example, the user is able to select one of ten different speed settings, each corresponding to a respective rotational speed of the motor 110. The number of the current speed setting is displayed on the display 74 as the speed setting is changed by the user.

The motor 110 is housed within a motor housing. The outer wall of the duct 100 surrounds the motor housing, which provides an inner wall of the duct 100. The walls of the duct 100 thus define an annular air flow path which extends through the duct 100. The motor housing comprises a lower section 114 which supports the motor 110, and an upper section 116 connected to the lower section 114. The shaft 108 protrudes through an aperture formed in the lower section 114 of the motor housing to allow the impeller 106 to be connected to the shaft 108. The motor 110 is inserted into the lower section 114 of the motor housing before the upper section 116 is connected to the lower section 114. The lower section 114 of the motor housing is generally frusto-conical in shape, and tapers inwardly in a direction extending towards the air inlet 102 of the duct 100. The upper section 116 of the motor housing is generally frusto-conical in shape, and tapers inwardly towards the air outlet 104 of the duct 100. An annular diffuser 118 is located between the outer wall of the duct 100 and the upper section 116 of the motor housing. The diffuser 118 comprises a plurality of blades for guiding the air flow towards the air outlet 104 of the duct 100. The shape of the blades is such that the air flow is also straightened as it passes through the diffuser 118. A cable for conveying electrical power to the motor 110 passes through the outer wall of the duct 100, the diffuser 118 and the upper section 116 of the motor housing. The upper section 116 of the motor housing is perforated, and the inner surface of the upper section 116 of the motor housing is lined with noise absorbing material 120, preferably an acoustic foam material, to suppress broadband noise generated during operation of the fan assembly 10.

The duct 100 is mounted on an annular seat located within the body 12. The seat extends radially inwardly from the inner surface of the outer casing 16 so that an upper surface of the seat is substantially orthogonal to the rotational axis Z of the impeller 106. An annular seal 122 is located between the duct 100 and the seat. The annular seal 122 is preferably a foam annular seal, and is preferably formed from a closed cell foam material. The annular seal 122 has a lower surface which is in sealing engagement with the upper surface of the seat, and an upper surface which is in sealing engagement with the duct 100. The seat comprises an aperture to enable the cable (not shown) to pass to the motor 110. The annular seal 122 is shaped to define a recess to accommodate part of the cable. One or more grommets or other sealing members may be provided about the cable to inhibit the leakage of air through the aperture, and between the recess and the internal surface of the outer casing 16.

To operate the fan assembly 10 the user either presses the actuator 24 to actuate the switch 56, or presses an "on/off" button of the remote control 26 to transmit an infrared light signal which passes through the actuator 24 to be received by the receiver 54 of the user interface circuit 48. The user interface circuit 48 communicates this action to the main control circuit 80, in response to which the main control circuit 80 starts to operate the motor 110. The LED 76 is activated to illuminate the actuator 24. The light signals emitted by the LED 76 are conveyed through the actuator 24 to illuminate the front surface 58 of the actuator 24.

The main control circuit 80 selects the rotational speed of the motor 110 from a range of values, as listed below. Each value is associated with a respective one of the user selectable speed settings.

| Speed setting | Motor speed (rpm) |
|---|---|
| 10 | 9000 |
| 9 | 8530 |
| 8 | 8065 |
| 7 | 7600 |
| 6 | 7135 |
| 5 | 6670 |
| 4 | 6200 |
| 3 | 5735 |
| 2 | 5265 |
| 1 | 4800 |

Initially, the speed setting which is selected by the main control circuit 80 corresponds to the speed setting which had been selected by the user when the fan assembly 10 was previously switched off. For example, if the user has selected speed setting 7, the motor 110 is rotated at 7,600 rpm, and the number "7" is displayed on the display 74.

The motor 110 rotates the impeller 106 causes a primary air flow to enter the body 12 through the air inlet 14, and to pass to the air inlet 102 of the duct 100. The air flow passes through the duct 100 and is guided by the shaped peripheral surface of the air outlet 104 of the duct 100 into the interior passage 42 of the nozzle 18. Within the interior passage 42, the primary air flow is divided into two air streams which pass in opposite angular directions around the bore 32 of the nozzle 18, each within a respective section 44, 46 of the interior passage 42. As the air streams pass through the interior passage 42, air is emitted through the air outlet 20. The emission of the primary air flow from the air outlet 20 causes a secondary air flow to be generated by the entrainment of air from the external environment, specifically from the region around the nozzle 18. This secondary air flow combines with the primary air flow to produce a combined, or total, air flow, or air current, projected forward from the nozzle 18.

If the user has used the remote control 26 to switch on the fan assembly 10, then the user may change the rotational speed of the motor 110 by pressing either a "speed up" button on the remote control 26, or a "speed down" button on the remote control 26. If the user presses the "speed up" button, the remote control 26 transmits a unique infrared control signal which is received by the receiver 54 of the user interface circuit 48. The user interface circuit 48 communicates the receipt of this signal to the main control circuit 80, in response to which the main control circuit 80 increases the rotational speed of the motor 110 to the speed associated with the next highest speed setting, and instructs the user interface circuit 48 to display that speed setting on the display 74. If the user presses the "speed down" button of the remote control 26, the remote control 26 transmits a different, unique infrared control signal which is received by the receiver 54 of the user interface circuit 48. The user interface circuit 48 communicates the receipt of this signal to the main control circuit 80, in response to which the main control circuit 80 decreases the rotational speed of the motor 110 to the speed associated with the next lowest speed setting, and instructs the user interface circuit 48 to display that speed setting on the display 74.

If the user has used to the actuator 24 to switch on the fan assembly 10, then if the user releases the actuator 24 within a preset period of time, which is preferably in the range from 0.5 to 5 seconds and in this example is 1 second, the motor 110 continues to rotate at a speed associated with the currently selected speed setting. The release of the actuator 24 breaks the contact between the actuator 24 and the switch 56, and this break in the contact of the switch 56 is communicated to the main control circuit 80. However, if the user continues to press the actuator 24 against the switch 56 for a duration which exceeds this preset period of time, the main control circuit 80 starts to gradually increase the rotational speed of the motor 110 from the speed associated with currently selected speed setting up to the speed associated with the highest speed setting. In this example, the rotational speed of the motor 110 is increased each 0.5 second to the speed associated with the next highest speed setting. For instance, if the user had selected speed setting 7, after 1 second the speed of the motor 110 is increased to 8,065 rpm, and the number "8" is displayed on the display 74. If the user continues to depress the actuator for a further 0.5 second, the speed of the motor 110 is increased to 8,530 rpm, and the number "9" is displayed on the display 74.

Once the highest speed setting "10" has been reached, and if the user continues to press the actuator 24 against the switch 56, the main control circuit 80 starts to gradually decrease the rotational speed of the motor 110 from the speed associated with highest speed setting down to the speed associated with the lowest speed setting. If that speed is reached and the user has still not released the actuator 24, the main control circuit 80 starts to gradually increase the rotational speed of the motor 110 from the speed associated with lowest speed setting up to the speed associated with the highest speed setting. This cyclical variation of the speed of the motor 110, with the speed of the motor 110 being changed after every 0.5 second, continues until the user releases the actuator 24 to break the contact between the actuator 24 and the switch 56. Once that contact has been broken, the current speed of the motor 110 is maintained.

The user may switch off the fan assembly 10 by pressing the "on/off" button of the remote control 26. The remote control 26 transmits an infrared control signal which is received by the receiver 54 of the user interface circuit 48. The user interface circuit 48 communicates the receipt of this signal to the main control circuit 80, in response to which the main control circuit 80 de-activates the motor 110 and the LED 76. The user may also switch off the fan assembly 10 by pressing the actuator 24 against the switch 56. If the user releases the actuator 24 within the preset period of time, the user interface circuit 48 communicates this to the main control circuit 80, in response to which the main control circuit 80 de-activates the motor 110 and the LED 76. However, if the user does not release the actuator 24 within the preset period of time, the cyclical variation in the speed of the motor 110 is restarted, and continues until the user releases the actuator 24.

The invention claimed is:

1. A control system for controlling an appliance, the control system comprising:

a remote control for transmitting light signals;

a control circuit for controlling at least one component of the appliance;

a user interface circuit for supplying control signals to the control circuit, the user interface circuit comprising a switch, a receiver for receiving light signals transmitted by the remote control, and a light emitting device; and an actuator for actuating the switch through movement of the actuator towards the switch, the actuator comprising a first surface, a second surface located adjacent to the receiver, and a third surface located adjacent to the light emitting device, wherein the switch is located between the second and third surfaces, wherein the actuator is configured to convey light signals received from the remote control to the receiver through a first light path between the first surface and the second surface of the actuator, and to convey light emitted by the light emitting device to the first surface through a second light path between the third surface and the first surface of the actuator, wherein the third surface is larger than the second surface.

2. The control system of claim 1, wherein at least a part of the actuator is formed from light transmissive material.

3. The control system of claim 1, wherein the first surface is substantially parallel to the second surface.

4. The control system of claim 1, wherein the actuator is moveable relative to the switch in a direction which is substantially perpendicular to the first surface.

5. The control system of claim 1, wherein the first surface of the actuator is engageable by a user to move the actuator towards the switch.

6. The control system of claim 1, wherein the third surface is substantially parallel to the first surface.

7. The control system of claim 1, wherein the light signals are infrared light signals.

8. The control system of claim 1, wherein the actuator is biased away from the switch.

9. The control system of claim 1, wherein the actuator is a push button actuator.

* * * * *